US009528229B2

(12) United States Patent
Gazzola

(10) Patent No.: US 9,528,229 B2
(45) Date of Patent: Dec. 27, 2016

(54) LATTICE TRUSS

(71) Applicant: POLITECNICO DI MILANO, Milan (IT)

(72) Inventor: Filippo Gazzola, San Giorgio Piacentino (IT)

(73) Assignee: POLITECNICO DI MILANO, Milan (IT)

( * ) Notice: Subject to any disclaimer, the term of this patent is extended or adjusted under 35 U.S.C. 154(b) by 0 days.

(21) Appl. No.: 14/654,068

(22) PCT Filed: Dec. 12, 2013

(86) PCT No.: PCT/IB2013/060857
§ 371 (c)(1),
(2) Date: Jun. 19, 2015

(87) PCT Pub. No.: WO2014/097066
PCT Pub. Date: Jun. 26, 2014

(65) Prior Publication Data

US 2015/0354151 A1 Dec. 10, 2015

(30) Foreign Application Priority Data

Dec. 20, 2012 (IT) ..... BG2012A0054

(51) Int. Cl.
*E01D 6/00* (2006.01)
*E04C 3/08* (2006.01)
(Continued)

(52) U.S. Cl.
CPC . *E01D 6/00* (2013.01); *E04B 1/19* (2013.01); *E04C 3/08* (2013.01); *E04C 3/083* (2013.01);
(Continued)

(58) Field of Classification Search
CPC ..... E01D 6/00; E01D 2/04; E01D 1/00; E01D 19/00; E01D 2101/30; E04B 1/19; E04C 3/08; E04C 3/083; E04C 2003/0495; E04G 1/17
See application file for complete search history.

(56) References Cited

U.S. PATENT DOCUMENTS 3,083,793 A * 4/1963 Brout ..... E04B 1/19 52/222
4,642,830 A * 2/1987 Richard ..... E01D 6/00 14/13
(Continued)

FOREIGN PATENT DOCUMENTS

GB 2490767 A 11/2012
KR 20110037197 A 4/2011

*Primary Examiner* — Abigail A Risic
(74) *Attorney, Agent, or Firm* — King & Schickli, PLLC

(57) ABSTRACT

A lattice truss includes two upper beams (20, 53) and two lower beams (20, 53); an upper horizontal frame (21, 50) fixed to the two upper beams (20, 53); a lower horizontal frame (22, 50) fixed to the two lower beams (20, 53); two side frames (23) respectively connected to one of the two upper beams (20) and to one of the two lower beams (20); characterized in that the upper horizontal frame (21, 50) and, the lower horizontal frame (22, 50) are connected together by way of truss segments (24, 26, 35, 37, 52, 54) connected together in a Y shape with angles equal to one-third of the round angle.

20 Claims, 3 Drawing Sheets

Figure 9A:
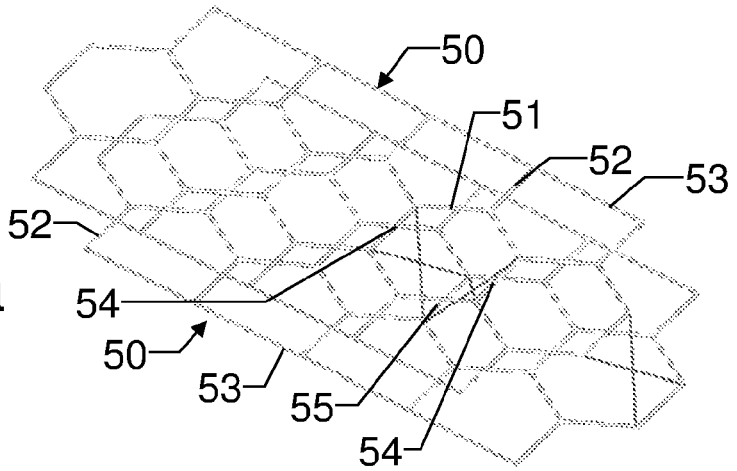

(51) Int. Cl.
*E04B 1/19* (2006.01)
*E04G 1/17* (2006.01)
*E04C 3/04* (2006.01)

(52) U.S. Cl.
CPC ..... *E04G 1/17* (2013.01); *E04C 2003/0495* (2013.01)

(56) References Cited

U.S. PATENT DOCUMENTS 4,923,544 A * 5/1990 Weisse ..... E04C 2/326 156/153
4,967,533 A * 11/1990 Weisse ..... B29C 33/42 428/180
5,040,966 A * 8/1991 Weisse ..... B29C 33/42 249/175
5,070,673 A * 12/1991 Weisse ..... B29C 33/42 428/116
6,804,927 B2 * 10/2004 Forsyth ..... E01D 6/00 14/13
2011/0011027 A1 * 1/2011 Camber ..... B66B 11/0005 52/653.1
2012/0151868 A1 * 6/2012 Kang ..... B21F 27/128 52/649.1
2015/0292168 A1 * 10/2015 Furlanetto ..... E01D 6/00 14/6

* cited by examiner

Fig. 1
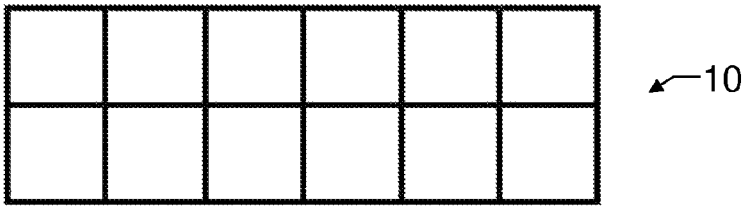
Fig. 2
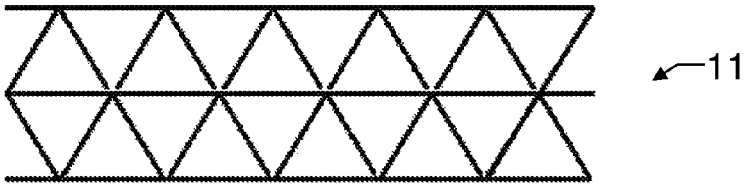
Fig. 3
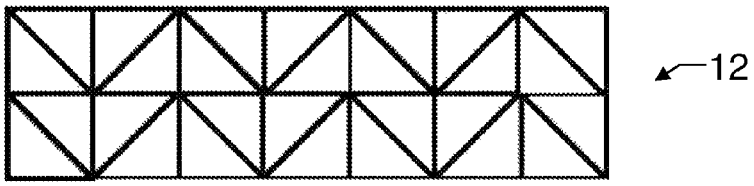
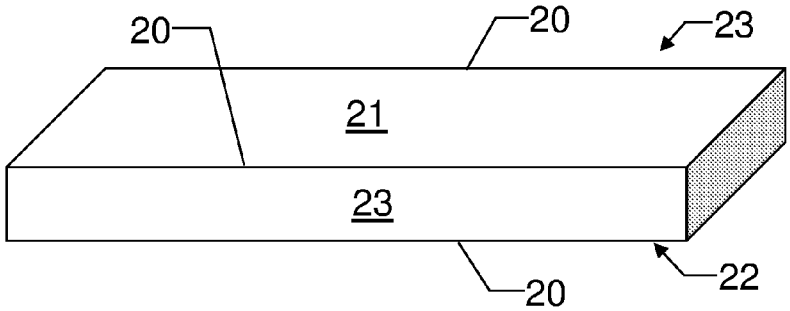
Fig. 4

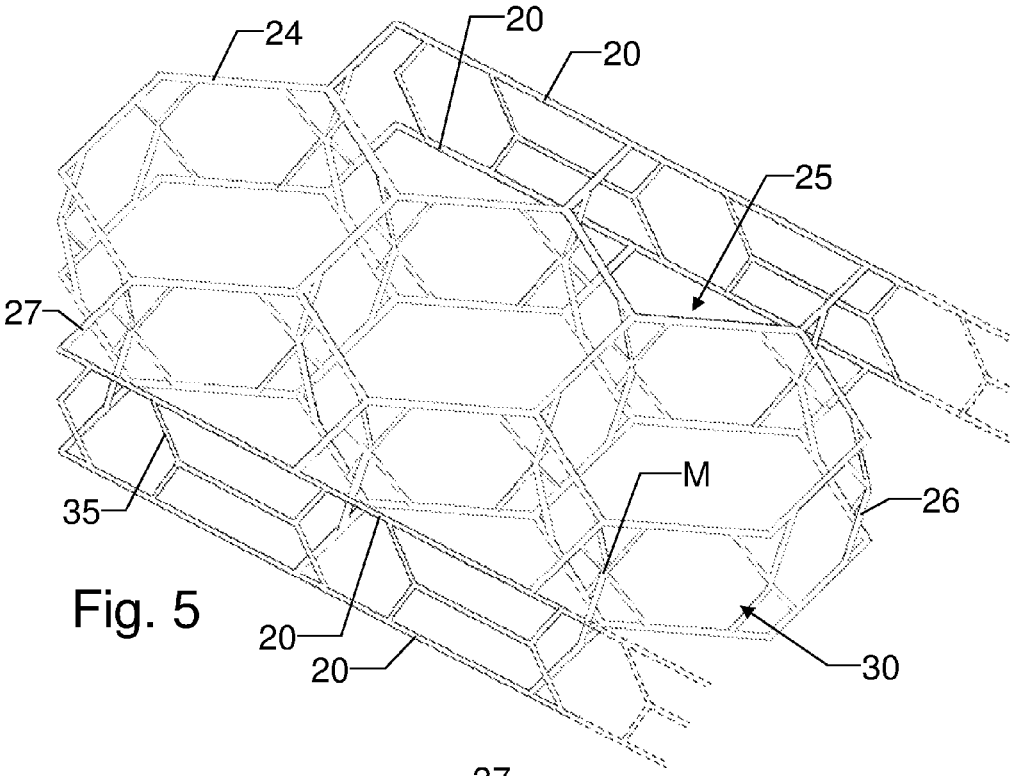
Fig. 5
Fig. 6
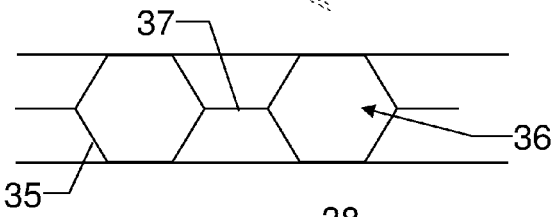
Fig. 7
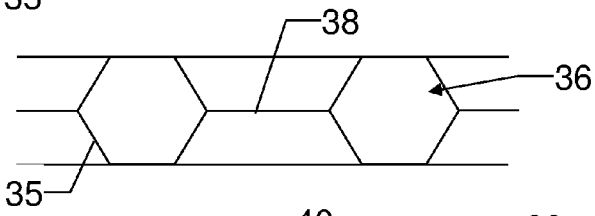
Fig. 8
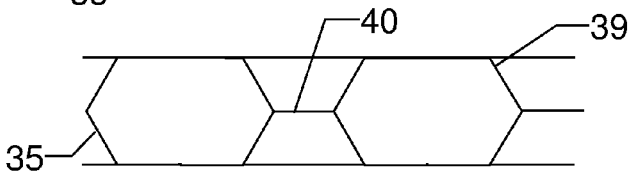

LATTICE TRUSS

This application is the national stage of PCT/IB2013/060857, filed Dec. 12, 2013, which claims priority from Italian Application No. BG2012A000054, filed Dec. 20, 2012.

FIELD OF THE INVENTION

The present invention relates to a lattice truss, and in particular for supporting a suspension bridge.

BACKGROUND OF THE INVENTION

Industrial applications of the present invention relate to the construction of trusses for small and large spanning bridges, trusses for other structures that need support (comprising industrial warehouses). Finally, the same design can be used for lattice structures, such as scaffolding of any kind, comprising scaffolding for renovation projects that require a "cage".

After the well-known collapse of the Tacoma bridge in 1940, the designers of bridges have felt the need to reinforce the road bed with metal trusses that would dampen oscillations. In the Tacoma bridge two types of oscillations were visible: the longitudinal and torsional ones. Those that caused the collapse were certainly of the torsional type, which in turn were generated by the longitudinal ones.

Immediately after the collapse of the bridge in Tacoma, there have been several attempted explanations, starting from possible mathematical theories. But there have not been significant modeling progress. The reason is certainly to be attributed to the enormous difficulties of the theory of elasticity; many relatively simple problems still remain unanswered. In addition, the growing awareness of the strong nonlinearities in the oscillatory behavior of bridges, has dissuaded many generations from seeking precise theories. To date there is not a theory that accurately describes the oscillatory behavior of the bridges that neither is able to fully explain the collapse of the Tacoma bridge.

Subsequently, several other bridges have shown strong oscillations that, in some cases, have led to their collapse.

It is therefore necessary to find the best way to mitigate the longitudinal oscillations and prevent the formation of torsional oscillations. It is clear that both oscillations can be eliminated with very stiff, heavy and expensive trusses. Recently the problem has been raised of what could be the right balance between stiffness and economy; regarding economy which means not only the direct economy of material but also the indirect economy of a structure with a smaller mass and that needs support towers and cables with more modest performance.

To dampen the oscillations of the bridge, under the road bed are usually positioned horizontal metal trusses framed with different types of shapes, typically polygonal. There are two or more layers of these horizontal trusses connected to each other with vertical trusses or with frames, similar or different depending on the structure.

In the book of T. Kawada, titled "History of the Modern Suspension Bridge: solving the dilemma between economy and stiffness", ASCE Press (2010), are reviewed reinforcement trusses of the existing suspension bridges and described ways to connect with each other the different truss segments. Among the shapes most frequently used are the squares 10, the equilateral triangles 11 and the rectangles isosceles triangles 12.

SUMMARY OF THE INVENTION

Purpose of the present invention is to provide a lattice truss which is lightweight while maintaining or improving the technical performance.

According to the present invention, these and other objects are achieved by a lattice truss comprising: two upper beams and two lower beams; an upper horizontal frame secured to said two upper beams, a lower horizontal frame fixed to said two lower beams; two side frames respectively connected to one of said two upper beams and to one of said two lower beams; characterized in that said upper horizontal frame and said lower horizontal frame are connected together by truss segments connected together in Y shape with angles equal to one-third of the round angle (see FIGS. 5 and 9 for examples).

Further characteristics of the invention are described in the dependent claims.

The advantages of this solution compared to the solutions of the prior art are different.

The use of hexagonal shape grids, or otherwise the use of truss segments connected to one another in Y shape with angles equal to one-third of the round angle, allows for the same length of the truss, to reduce both the moment of the forces applied and the amount of energy stored by the structure. Also, to overcome the established nonlinear oscillatory behavior, it is proposed a coupling between vertical and horizontal trusses according to an appropriate rule that allows to reduce the oscillations of a bridge with a smaller amount of material.

In addition to the hexagonal shape, particular advantages are given by the coupling between the different sizes of the vertical and horizontal hexagons; and this serves to break the symmetry of the structure preventing the formation of longitudinal oscillations due to wind stresses or vehicular traffic loads.

The structure according to the present invention is also very simple to implement because with only three measures of truss segments it is possible to obtain the whole structure.

BRIEF DESCRIPTION OF THE DRAWING FIGURES

Figure 9B:
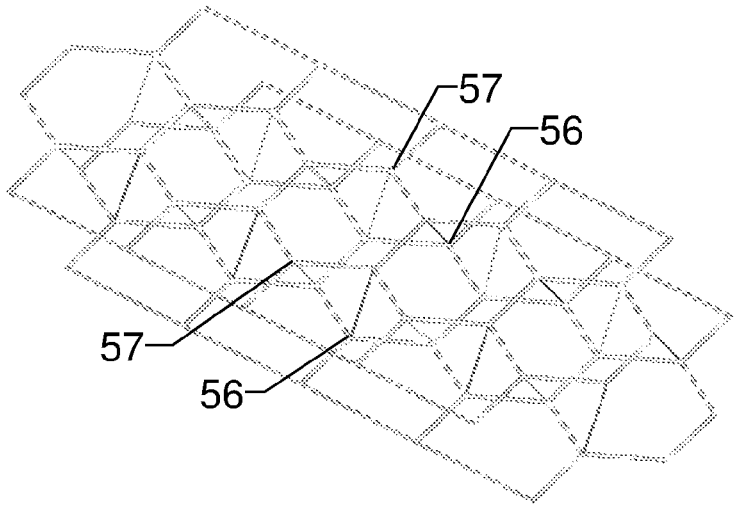
Figure 9C:
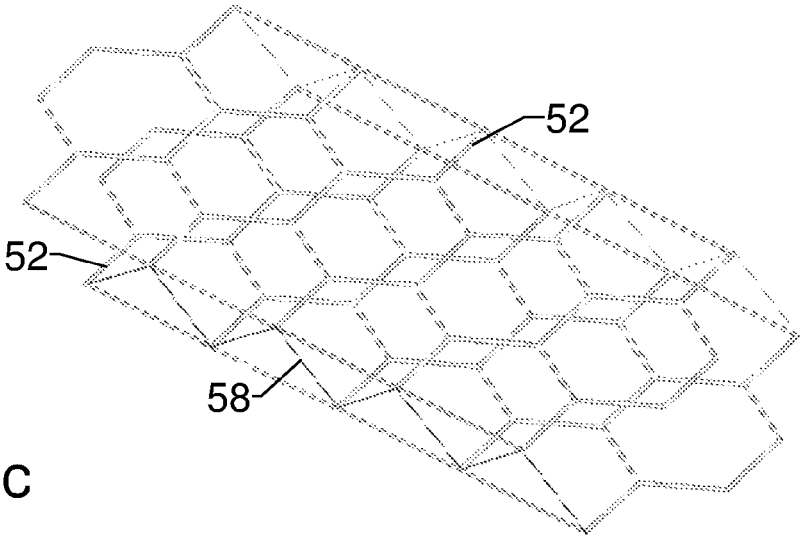

The characteristics and advantages of the present invention will become apparent from the following detailed description of an embodiment thereof, that is illustrated by way of non-limiting example in the accompanying drawings, wherein:

FIG. 1 schematically shows a support structure of a bridge, according to a first embodiment, square-shaped, of the prior art;

FIG. 2 schematically shows a support structure of a bridge, according to a second embodiment, equilateral triangle-shaped, of the prior art;

FIG. 3 schematically shows a support structure of a bridge, according to a third embodiment, rectangles isosceles triangle-shaped, of the prior art;

FIG. 4 schematically shows a geometrical figure, in perspective view, defining the components of a support structure of a bridge;

FIG. 5 schematically shows a portion of a lattice truss, according to the present invention;

FIG. 6 schematically shows a first embodiment of a connecting side frame of a support structure of a bridge, according to the present invention;

FIG. 7 schematically shows a second embodiment of a connecting side frame of a support structure of a bridge, according to the present invention;

FIG. 8 schematically shows a third embodiment of a connecting side frame of a support structure of a bridge, according to the present invention;

FIGS. 9*a*, 9*b* and 9*c* schematically show a portion of a lattice truss, divided into three parts to facilitate the understanding of the links, according to a variant of the present invention. Referring to the attached figures, a lattice truss, in particular of support to a suspension bridge, according to the present invention, comprises four straight beams 20, as long as the entire length of the bridge. It comprises an upper horizontal frame fixed to the two upper beams 20 and a lower horizontal frame 22 fixed to the two lower beams 20.

DETAILED DESCRIPTION OF THE INVENTION

It further comprises two side frames 23 connected respectively to the two pairs of side beams 20.

Depending on the size of the bridge and on the loads the horizontal frames can be greater than two in number, and they must be fixed together by more side frames.

The horizontal frames 21 and 22 are constituted by truss segments 24 connected one to the other in Y shape with three output joints and with angles equal to one third of the round angle. Said truss segments 24 then form regular hexagons 25 of side L. The side length L depends on the size of the bridge and the loads involved but should be about 2 m.

In the figure is shown only a portion of a frame and said hexagons 25 should be repeated as many times as required by the width and length of the bridge.

Note that the connection of the truss segments with the beams 20 (sides of the bridge) is performed in a perpendicular way. Depending on the width of the bridge, the truss segments 24 used for the connection with the beams 20, having the reference number 27, must have a size comprised between ¼*L and ¾*L, so as to avoid too long cantilevered segments.

The upper horizontal frame 21 is positioned at a distance from the lower horizontal frame 22 equal to $\sqrt{3}L/2$ (the root of 3 times L divided by 2), which is the diameter of a circle inscribed in a regular hexagon of side L/2.

Moreover, the upper horizontal frame 21 is positioned so that its hexagons 25 are in correspondence of the hexagons 25 of the lower horizontal frame 22.

Between each side of each hexagon 25 of the upper horizontal frame 21 and each side of each hexagon 25 of the lower horizontal frame 22, a regular hexagon 30 of side L/2 must be formed, exactly in the middle of the sides of the hexagons 25. So the hexagons 30 are made with truss segments 26 of length L/2.

Also, as can be seen, once defined the length of the truss segments 26 equal to L/2, the distance of $\sqrt{3}L/2$ between the frames 21 and 22, which is calculated based on the Pythagorean Theorem, is not directly involved in the construction and assembly step of these new hexagons 30.

In this way, the two intermediate vertices of the vertical hexagon (those that are in mid-distance between the horizontal frames) are exactly in the middle point M of the (virtual) vertical segment that has two vertices of horizontal hexagons as ends. From the middle point M branch six truss segments 26.

The vertical hexagons 30, which are positioned between the sides of the upper and lower horizontal hexagons 25 hook in a perpendicular way to the straight beams 20. Given that, as mentioned above, the side portion 27 of the horizontal hexagon 25 will be comprised between ¼*L and ¾L, the vertical hexagon 30 has the horizontal sides that are hooked to the beams 20. This happens precisely because the side portion 27 is comprised between ¼*L and ¾*L.

The two side frames 23, of side connection between the frames 21 and 22 also comprise hexagons 36, or in any case are composed by truss segments 35 connected together in a Y shape.

In, particular, in a first possible embodiment of a side frame 23 for connection of a support structure of a bridge are only used truss segments equal to L/2. Therefore there are regular hexagons 36 connected together, centrally between their vertices, by a horizontal truss segment 37 of connection between two consecutive hexagons 36.

In a second possible embodiment, hexagons 36 of oblique side 35 of length L/2 are formed while the horizontal truss segment 38 of connection between two consecutive hexagons 36 is of a different length from L/2.

In a third possible embodiment, hexagons 39 are formed whose horizontal fixing sides of the straight beams 20 have a different length than L/2.

Reducing these horizontal distances corresponds to obtaining a more solid structure; conversely, increasing these distances means to lighten the frame. These two distances are to be set according to the performance required from the bridge. The only fixed point is the distance equal to one-third of the round angle.

As described above, three different lengths of the various segments of the beam are required: 24 (length L), 26, 35, 37 (length L/2), 27 (length to be determined depending on the size of the bridge).

First the size of the horizontal hexagonal mesh 24 is defined with sides equal to L, and in consequence of this length, the length of the side of the vertical hexagonal mesh 26 equal to L/2 is determined.

Depending on the width of the bridge as the length of the truss segments 24 used for connecting beams 20 is defined, with the reference number 27, comprised between ½*L and ¾*L.

The connection between the different truss segments can be achieved with normal connection methods, such as to fix the ends of the truss segments with plates or three inlet gussets, or provide a component Y on which to fasten (lock) the beams.

The materials used to implement the support system of a suspension bridge, as well as the dimensions, may be varied depending on the requirements and the state of the art.

To evaluate the advantages over the prior art the following must be considered.

The surface X to support (road bed: length to width) is a given factor of the problem and is expressed in square meters. Suppose wanting to support the road with a truss of length LL also pre-determined, expressed in linear meters. Then, for each polygonal shape, it is possible to determine the length of the largest side of the polygon forming the frame as a function of the quotient X/LL in linear meters. We list below the multiplication coefficient (normalized) of the quotient X/LL to determine the length of the beam segments of the different shapes.

| | Type of polygon | | | |
|---|---|---|---|---|
| | Rectangle triangle | Equilateral triangle | Square | Hexagon |
| Length maximum side (m) | 4.83 | 3.46 | 2 | 1.15 |

As can be seen, the hexagons have beam segments of lesser length and therefore with greater resistance to loads: this means better performance, or, for equal performance, lower section of the beam segment and therefore lower costs. The moment of a force applied is equal to the distance from the fulcrum to the intensity of the force: therefore, with the same load applied in the middle of the truss segment, the moments of the respective forces follow the proportions of the above table. To obtain equal performance of the hexagonal structure is thus possible to reduce the total mass (and therefore the section of the truss) following proportions expressed by the previous table.

There are also advantages with respect to the amount of stored elastic energy that is lower than other shapes; then, again, better performance or, for equal performance, lower cost and lower weight of the structure. We list below the multiplicative coefficient of the total elastic energy of the surface to be supported (suitably normalized) for various polygonal shapes.

| | Type of polygon | | | |
|---|---|---|---|---|
| | Rectangle triangle | Equilateral triangle | Square | Hexagon |
| Normalized elastic energy | 34 | 32 | 27 | 24 |

It was also desired to experiment a new performance evaluation parameter called medium square distance. The exact definition is rather technical and is omitted here; however, the performance is always best for the hexagonal truss.

The advantage determined by the combination between the sizes of the horizontal and vertical hexagons is to break the symmetry of the system and thus to counteract the non-linear behavior of the bridge. Finally, from the environmental point of view, there would be an advantage in savings of the quantity to be produced, and therefore in energy.

In an embodiment variant the lattice truss, shown in three parts to facilitate the understanding of the links, comprises two horizontal frames 50 (upper and lower) formed by regular hexagons 51 which hook perpendicularly, by means of connecting beams 52, to the side beams 53 that delimit the frame. All the angles internal to the frame are 120°. The two horizontal frames 50 are overlayed off-set in phase opposition, i.e. the sides 54 of the upper hexagons 51, perpendicular to the side beams 53, are superimposed in the center of the lower hexagons 51 (ends 56 of the lower hexagon 51). In this way the hexagons of the upper frame are not aligned to the hexagons of the lower frame.

The upper hexagons are connected to the lower hexagons 51 by joining the ends 51 of the sides 54 to the ends of the sides 55, perpendicular to the side beams 53, of the nearest lower hexagon (FIG. 9*a*).

Are represented only 3 crosses to avoid overloading the drawing.

There is a further connection between hexagons 51. The ends of the sides 54, of the upper hexagons 51, are connected to the central ends 56 of the lower hexagons 51. The central ends 57, of the upper hexagons 51, are connected to the central ends 55 of the lower hexagons 51 (FIG. 9*b*).

The side connection between the two horizontal frames 50 is achieved by connecting with beams 58 the end points of the connecting beams 52 of both the upper and lower frame 50 (FIG. 9*c*).

The dimensions of the truss depend on the design requirements; it is reasonable to think that the distance between parallel horizontal frames is at least ¼ of the width and at most equal to the width of the deck.

With this variant a greater flexibility in size is obtained: there are no longer such narrow constraints in the proportions of the various truss segments, measurements of the same can be adapted according to circumstances. In addition, the new frame has shown better performance with respect to bending and twisting, without prejudice to the already good performance related to the geometry and elastic energy. The lattice trusses thus conceived are susceptible to numerous modifications and variations, all within the scope of the inventive concept; moreover, all details are replaceable by technically equivalent elements.

The invention claimed is:

1. A lattice truss comprising: two upper beams and two lower beams; an upper horizontal frame fixed to said two upper beams; a lower horizontal frame fixed to said two lower beams; two side frames respectively connected to one of said two upper beams and to one of said two lower beams, characterized in that said upper horizontal frame and said lower horizontal frame are connected together by way of truss segments connected together in a Y shape with angles equal to one-third of the round angle.

2. The truss according to claim 1 characterized in that said two side frames are connected together by way of truss segments connected together in a Y shape with angles equal to one-third of the round angle.

3. The truss according to claim 1 characterized in that said truss segments connected together in a Y shape form a plurality of hexagons.

4. The truss according to claim 1 characterized in that first truss segments form part of said upper horizontal frame and second truss segments form part of said lower horizontal frame and have a length equal to L; and in that third truss segments form part of said two side frames and have a length equal to L/2.

5. The truss according to claim 1 characterized in that first truss segments being part of said upper horizontal frame and second truss segments of said lower horizontal frame are connected together by way of third truss segments of length L/2.

6. The truss according to claim 1 characterized in that each side, of length L, of an upper hexagon of said upper horizontal frame is connected to each side of a lower hexagon of said lower horizontal frame by way of another hexagon of length L/2.

7. The truss according to claim 1, wherein said truss segments have a length equal to L, and further characterized in that hexagons connect to said two upper beams and to said two lower beams, perpendicular with the truss segments, the hexagons having a length comprised between ¼*L and ¾*L.

8. The truss according to claim 1 wherein said truss segments have a length equal to L, and further characterized in that the distance between said upper horizontal frame and said lower horizontal frame is equal to a square root of 3L/2.

9. The truss according to claim 1 characterized in that said two side frames comprise hexagons connected together by horizontal truss segments.

10. The truss according to claim 1 characterized in that said truss is part of a support structure of a suspension bridge.

11. The truss according to claim 1 characterized in that said upper horizontal frame and said lower horizontal frame, equal one to the other, are mutually offset and overlapped.

12. The truss according to claim 1 characterized in that upper hexagons are connected to the lower hexagons joining ends of the truss segments, perpendicular to the side beams, of the upper horizontal frame, to ends of the truss segments, perpendicular to the side beams, of the upper horizontal frame, of a closest underlying hexagon.

13. The truss according to claim 6 characterized in that ends of sides of the upper hexagons, are connected to central ends of the lower hexagons, and central ends, of the upper hexagons, are connected to ends of sides of the lower hexagons.

14. A support system of a suspension bridge comprising a lattice truss according to claim 1.

15. A truss comprising: two upper beams and two lower beams; an upper horizontal lattice frame fixed to said two upper beams; a lower horizontal lattice frame fixed to said two lower beams; two side lattice frames respectively connected to one of said two upper beams and to one of said two lower beams, characterized in that said upper horizontal lattice frame and said lower horizontal lattice frame comprise truss segments connected together in a Y shape with angles equal to one-third of the round angle.

16. The truss according to claim 15 characterized in that each side, of length L, of an upper hexagon belonging to said upper horizontal frame is connected to each side of a lower hexagon belonging to said lower horizontal frame by way of another hexagon of side L/2.

17. The truss according to claim 15 characterized in that said two side frames comprise hexagons connected together by horizontal truss segments.

18. A lattice truss comprising: two upper beams and two lower beams; an upper horizontal frame fixed to said two upper beams; a lower horizontal frame fixed to said two lower beams; two side frames respectively connected to one of said two upper beams and to one of said two lower beams, characterized in that said upper horizontal frame and said lower horizontal frame are connected together by way of truss segments, said side frames comprising hexagons connected together by horizontal truss segments.

19. The truss of claim 18, wherein the upper and lower horizontal frames comprise truss segments connected together in a Y shape with angles equal to one-third of the round angle.

20. The truss of claim 18 characterized in that each side, of length L, of an upper hexagon of said upper horizontal frame is connected to each side of a lower hexagon of the lower horizontal frame by way of another hexagon of side L/2.

* * * * *